US006418622B2

(12) United States Patent
Garenfeld et al.

(10) Patent No.: US 6,418,622 B2
(45) **Date of Patent: *Jul. 16, 2002**

(54) WET SHAVER WITH RETRACTILE ACTION

(75) Inventors: Andreas J. Garenfeld; Petrus H. De Leeuw; Karim Lefki, all of Eindhoven (NL)

(73) Assignee: Koninklijke Philips Electronics N.V., Eindhoven (NL)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/383,288

(22) Filed: Aug. 25, 1999

(30) Foreign Application Priority Data

Aug. 31, 1998 (EP) ..... 98202895

(51) Int. Cl.[7] ..... B26B 19/38
(52) U.S. Cl. ..... 30/43; 30/43.92; 30/346.51
(58) Field of Search ..... 30/34.2, 43, 43.92, 30/346.51

(56) References Cited

U.S. PATENT DOCUMENTS 2,611,177 A * 9/1952 Halterman ..... 30/34.2
3,871,073 A * 3/1975 Nissen et al. ..... 30/34.2
3,962,784 A * 6/1976 Tietjens ..... 30/346.51
4,151,645 A * 5/1979 Tietjens ..... 30/346.51
4,272,884 A * 6/1981 Tietjens ..... 30/346.51
4,281,453 A * 8/1981 Bakker et al. ..... 30/346.51
4,336,650 A * 6/1982 Gorter ..... 30/34.2
4,490,906 A * 1/1985 Haes et al. ..... 30/34.2
4,512,077 A * 4/1985 Tanabe et al. ..... 30/43
4,813,133 A * 3/1989 Locke et al. ..... 30/43.92
5,544,415 A * 8/1996 Huang ..... 30/43.92

FOREIGN PATENT DOCUMENTS

EP 0559130 A1 9/1993 ..... B26B/21/22

* cited by examiner

*Primary Examiner*—M. Rachuba
(74) *Attorney, Agent, or Firm*—Ernestine C. Bartlett

(57) ABSTRACT

The invention relates to a shaving apparatus comprising a first blade (1) and a second blade (3) having parallel cutting edges (5, 7) extending perpendicularly to a cutting direction X of the blades. The second blade follows the first blade, viewed in the cutting direction. According to the invention, the first blade comprises a blocking element (15) which is provided on a side surface (17) of the first blade at a distance (d) from the cutting edge (5) of the first blade, which distance (d) is much smaller than an average diameter of a hair (25) to be shaved by the apparatus, the first blade being periodically displaceable in the cutting direction by a displacing unit (11) of the apparatus from a first position, in which the cutting edge of the first blade is close to the cutting edge of the second blade, to a second position. In a prefered embodiment, said distance (d) ranges between 10 $\mu$m and 50 $\mu$m, and is in particular 30 $\mu$m. In a preferred embodiment, the blocking element (15) is a front surface (19) of a carrier (13) of the first blade, a blade part (14) comprising the cutting edge of the frist blade being mounted on said carrier. The shaving apparatus performs a retractile action, so that a shaving result achieved by the apparatus is maintained for a long period of time.

12 Claims, 4 Drawing Sheets

WET SHAVER WITH RETRACTILE ACTION

BACKGROUND OF THE INVENTION

The invention relates to a shaver comprising a skin-support element, a first blade, and a second blade which, viewed in a cutting direction of the blades, follows the first blade, said blades being provided with substantially parallel cutting edges extending perpendicularly to the cutting direction and substantially in a hair cutting plane touching the skin-support element.

The invention also relates to a shaving head which can suitably be used in a shaver in accordance with the invention.

A shaver of the type mentioned in the opening paragraph is known from EP-A-0 559 130. The known shaver is a wet shaver in which both blades are fitted in substantially fixed positions in a shaving head which is detachably secured to a holder of the shaver. To shave hairs, the known shaver has to be placed on the skin, the skin touching the skin-support element and the two blades, and the shaver has to be moved over the skin in the cutting direction. As a result, hairs near the hair cutting plane of the shaver, i.e. directly above the surface of the skin, are severed by the blades, resulting in a fairly smooth shaving result.

A drawback of the known shaver is that the shaving result attained lasts only a relatively short period of time. This drawback can be attributed to the fact that hairs severed by means of the known shaver relatively rapidly grow beyond the surface of the skin again.

SUMMARY OF THE INVENTION

It is an object of the invention to provide a shaver of the type mentioned in the opening paragraph, in which the above-mentioned drawback is precluded as much as possible, so that an attained shaving result lasts a longer period of time.

To achieve this, the shaver in accordance with the invention is characterized in that the first blade is provided with a blocking element which is provided on a side face of the first blade at a distance from the cutting edge of the first blade which is substantially smaller than an average diameter of hairs to be shaved by means of the shaver, while the first blade can be periodically moved by means of a drive unit substantially in the cutting direction from a first position, in which the cutting edge of the first blade is situated close to the cutting edge of the second blade, to a second position. By applying said blocking element on the first blade, the shaver in accordance with the invention obtains a so-called retractile action, as will be explained hereinbelow. If the shaver in accordance with the invention is moved over the skin in the cutting direction, a hair to be severed is first reached by the cutting edge of the first blade. Since the first blade is provided with said blocking element, the cutting edge of the first blade penetrates the hair only over a distance which corresponds to the distance between the cutting edge of the first blade and the blocking element, which distance, consequently, is substantially smaller than the diameter of the hair. A further penetration of the cutting edge of the first blade into said hair is precluded by the blocking element because the blocking element cannot penetrate into the hair. As the first blade is subsequently moved by means of the drive unit in the cutting direction from the first position to the second position, said hair is pulled along by the first blade in the cutting direction and hence partly extracted from the skin. Subsequently, the hair thus partly extracted from the skin is severed by the second blade directly above the surface of the skin, whereafter the hair is finally retracted into the skin by the skin tissue present around the hair shaft. As a result, the severed hair sinks back below the surface of the skin, so that not only a very smooth shaving result is obtained but, in addition, the shaving result thus obtained is maintained for a longer period of time because the severed hair does not directly grow beyond the surface of the skin. It is noted that the above-mentioned distance over which the cutting edge of the first blade penetrates the hairs should be such that the hairs can be pulled along by the first blade, but are not severed by said first blade. It has been found that, to achieve this, the distance between the cutting edge of the first blade and the blocking element must be substantially smaller than an average diameter of the hairs to be shaved by means of the shaver.

A particular embodiment of a shaver in accordance with the invention is characterized in that the distance between the cutting edge of the first blade and the blocking element ranges between 10 $\mu$m and 50 $\mu$m. As a result, the shaver in accordance with the invention can particularly suitably be used to attain a smooth, longer-lasting shaving result when shaving off beard hairs, which customarily have an average diameter of approximately 100 $\mu$m.

A further embodiment of a shaver in accordance with the invention is characterized in that the distance between the cutting edge of the first blade and the blocking element is substantially 30 $\mu$m. It has been found that, by virtue thereof, the shaver in accordance with the invention has a substantially optimum retractile action during shaving beard hairs.

Yet another embodiment of a shaver in accordance with the invention is characterized in that the blocking element is provided on a side face of the first blade facing away from the second blade. By virtue thereof, it is achieved that the distance over which the cutting edge of the first blade penetrates into the hairs substantially does not deviate from the distance between the cutting edge of the first blade and the blocking element, so that a reliable operation of the shaver is attained.

A particular embodiment of a shaver in accordance with the invention is characterized in that the first blade comprises a carrier on which a blade part including the cutting edge of the first blade is secured, the blocking element being a front side of the carrier extending transversely to the side face of the first blade. By virtue thereof, a simple and practical construction of the shaver in accordance with the invention and the blocking element applied therein is achieved.

A further embodiment of a shaver in accordance with the invention is characterized in that the shaver is provided, near the hair cutting plane, with a guide extending substantially parallel to the cutting direction, along which guide the first blade is guided during displacements from the first position to the second position. By using said guide, the first blade is accurately guided in the cutting direction during displacements from the first position to the second position. By virtue thereof, skin lesions are precluded as much as possible.

Yet another embodiment of a shaver in accordance with the invention is characterized in that the guide comprises at least one strip which extends substantially parallel to the cutting direction, which strip is formed by incisions in the second blade and is bent from said second blade. In this manner, a particularly simple and practical construction of the shaver in accordance with the invention is obtained.

A particular embodiment of a shaver in accordance with the invention is characterized in that the drive unit is provided with a coupling member which can be oscillated, through a limited angle, about a first pivot axis, while the first blade is displaceably guided in a guide channel of the shaver, which channel extends obliquely with respect to the hair cutting plane, the first blade being pivotable, through limited angles, in the guide channel about a second pivot axis extending parallel to the first pivot axis, the first blade being provided with at least one hinge element which can be hinged in a hinge channel of the coupling member extending parallel to the first pivot axis, and which hinge element can be displaced in the hinge channel in a direction transverse to the hair cutting plane. In this embodiment of the shaver in accordance with the invention, the cutting edge of the first blade is periodically displaced with respect to the second blade by means of the drive unit so as to follow an approximately triangular or quadrangular path. Said path comprises a first path part directed parallel to the cutting direction and extending from the first position to the second position, and a second path part directed obliquely with respect to the cutting direction and extending from the second position to a third position, wherein the first blade is situated behind the second blade, viewed with respect to the hair cutting plane.

A further embodiment of a shaver in accordance with the invention is characterized in that the second pivot axis is determined by lugs, which are formed by incisions in the first blade and are bent from the first blade, the first blade also being displaceably guided in the guide channel by means of said lugs. In this manner, a very simple and practical construction of the shaver is obtained.

Yet another embodiment of a shaver in accordance with the invention is characterized in that the skin-support element and the two blades form part of a shaving head of the shaver, which shaving head is detachably secured to a holder of the shaver, the drive unit being situated in the holder and being detachably coupled to the first blade. If, after repeated use of the shaver, the blades have become blunt, said blades can be readily replaced by substituting the shaving head with a new shaving head.

A particular embodiment of a shaver in accordance with the invention is characterized in that the shaving head is provided with a coupling guide extending parallel to the two pivot axes, which coupling guide serves to co-operate with a further coupling guide of the holder, the shaving head being detachable from the holder by sliding both coupling guides apart in a direction parallel to both pivot axes, the first blade simultaneously being detachable from the drive unit by sliding the hinge element of the first blade out of the hinge channel of the coupling member in a direction parallel to the two pivot axes. In this manner, a particularly simple and practical coupling between the shaving head and the holder, and between the first blade and the drive unit, is obtained.

BRIEF DESCRIPTION OF THE DRAWINGS

These and other aspects of the invention will be apparent from and elucidated with reference to the embodiment(s) described hereinafter.

In the drawings.

DESCRIPTION OF THE PREFERRED EMBODIMENTS

Figure 1A:
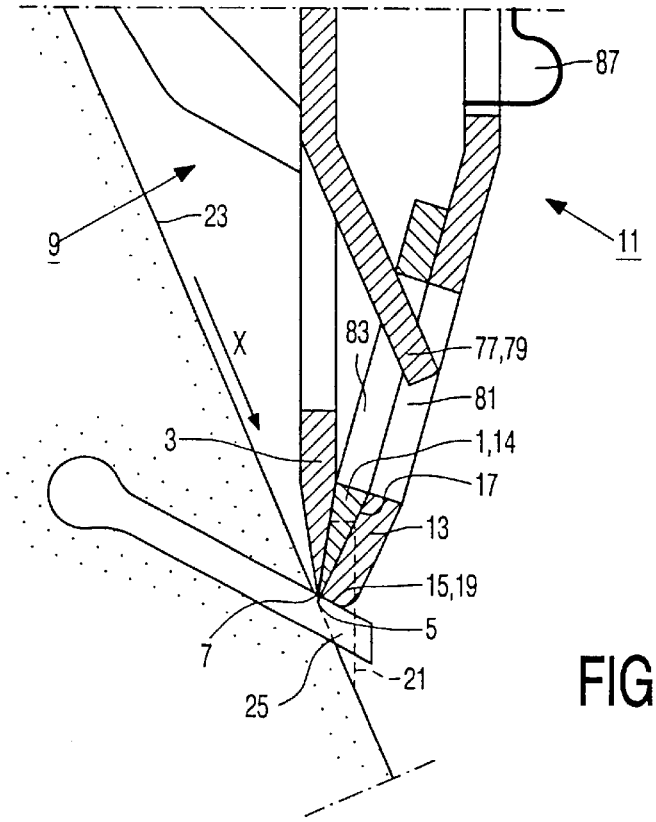
FIGS. 1*a* through 1*d* show in detail a hair-cutting process using a shaver in accordance with the invention.

FIGS. 1*a* through 1*d* show, in detail, a first blade 1 and a second blade 3 of a shaver in accordance with the invention. The second blade 3 follows the first blade 1, viewed in a cutting direction X of the blades 1 and 3. The first blade 1 has a cutting edge 5 extending perpendicularly to the cutting direction X, while the second blade 3 has a cutting edge 7 extending perpendicularly to the cutting direction X and parallel to the cutting edge 5 of the first blade 1. In the FIGS. 1*a* through 1*d*, the cutting edges 5 and 7 extend in a direction perpendicular to the plane of the Figures. The second blade 3 is secured in a fixed position to a shaving head 9 of the shaver, which will be described in detail hereinbelow. The first blade 1 is displaceable relatively to the second blade 3, in a manner which will be described in greater detail hereinbelow, by means of a drive unit 11 of the shaver, which will also be described in greater detail hereinbelow. The first blade 1 comprises a plate-shaped carrier 13, which is drivable by the drive unit 11, and a blade part 14 which is secured to the carrier 13 and which includes the cutting edge 5.

As the FIGS. 1*a* through 1*d* further show, the first blade 1 is provided with a blocking element 15 which is provided on a side face 17 of the first blade 1 facing away from the second blade 3. In the shown example of the shaver in accordance with the invention, the blocking element 15 is a front side 19 of the carrier 13 which extends transversely to the side face 17 of the first blade 1. In accordance with the invention, the blocking element 15 is provided at a distance d from the cutting edge 5 of the first blade 1, said distance d being shown in the FIGS. 1*b* and 1*d* and being substantially smaller than an average diameter of hairs to be shaved by means of a shaver in accordance with the invention. In the shown example of the shaver in accordance with the invention, the distance d is approximately 30 $\mu$m.

Figure 1B:
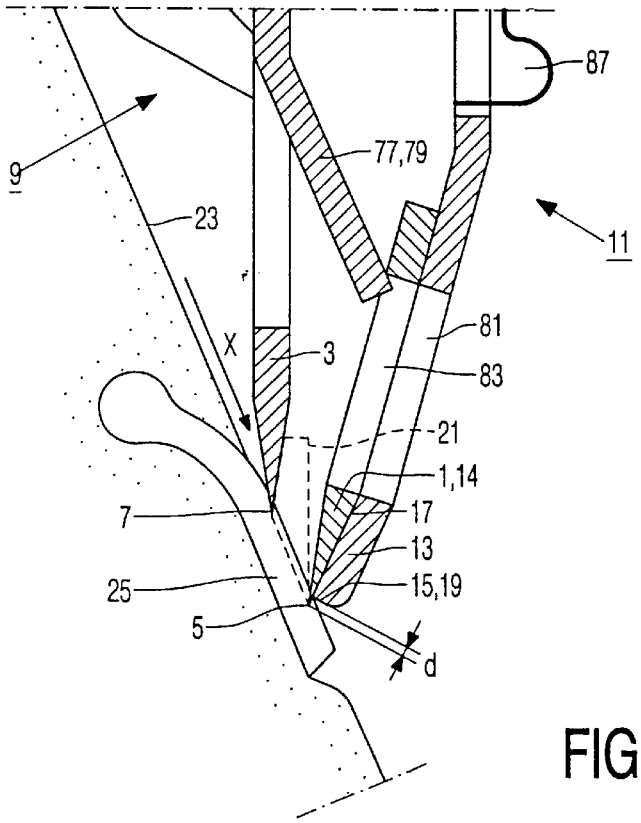
Figure 1C:
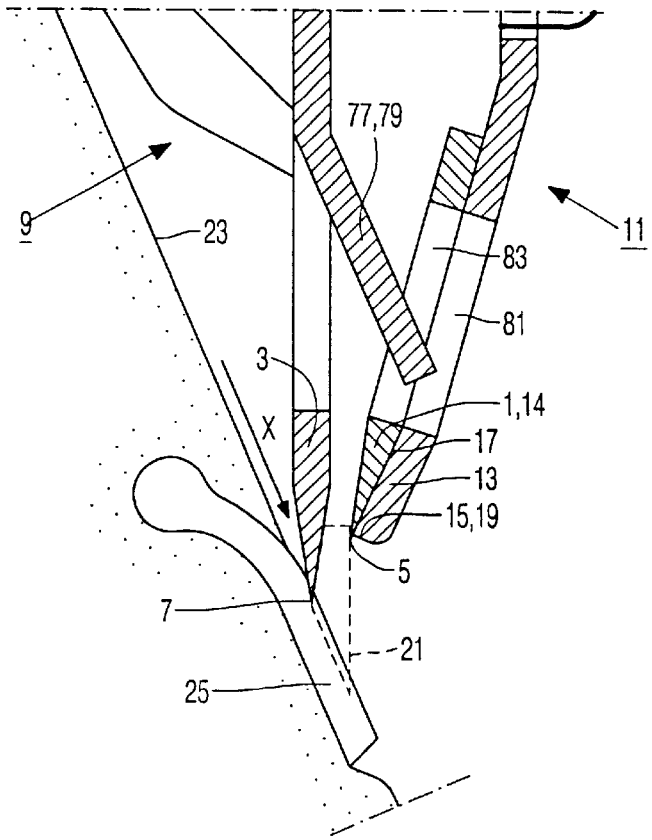
Figure 1D:
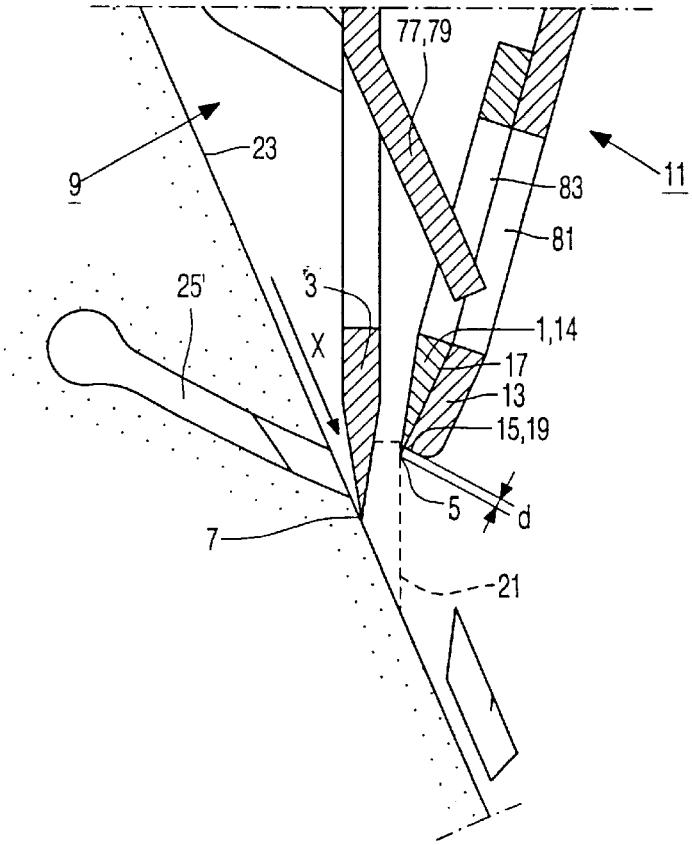

In operation, the first blade 1 is periodically displaced, by means of the drive unit 11, with respect to the second blade 3 so as to follow a substantially triangular or quadrangular path 21 which is shown in the FIGS. 1*a* through 1*d* by means of dashed lines. Said periodical displacement of the first blade 1 has a relatively high frequency, for example 100 Hz or 1000 Hz. If the shaver is displaced over a skin surface 23 in the cutting direction X, then a hair-cutting process as shown in FIGS. 1*a* through 1*d* is obtained. As the second blade 3 follows the first blade 1, viewed in the cutting direction X, first the cutting edge 5 of the first blade 1 will come into contact with a hair 25 to be severed when the shaver is displaced over the skin surface 23 in the cutting direction X. FIG. 1*a* shows a first position of the first blade 1, in which the cutting edge 5 of the first blade 1 is situated close to the cutting edge 7 of the second blade 3. From the first position, the first blade 1 is displaced substantially in the cutting direction X, by means of the drive unit 11, to a second position shown in FIG. 1*b*. Owing to the presence of the blocking element 15 on the side face 17 of the first blade 1, the cutting edge 5 of the first blade 1 only penetrates the hair 25 over a distance which is determined by the distance d between the cutting edge 5 of the first blade 1 and the blocking element 15. A further penetration of the cutting edge 5 of the first blade 1 into the hair 25 is precluded by the blocking element 15 because the blocking element 15 cannot penetrate the hair 25. Since the distance d is substantially smaller than an average diameter of hairs to be shaved by means of the shaver, the hair 25 is not severed by the first blade 1, but instead the hair 25 is pulled along by the first blade 1 in the cutting direction X during the displacement of the first blade 1 from the first position to the second position, so that the hair 25 is partly extracted from the skin, as shown in FIG. 1*b*. In the second position of the first blade 1 shown in FIG. 1*b*, the cutting edge 7 of the second blade 3 has reached the hair 25. The hair 25 which is partly extracted from the skin, is penetrated by the cutting edge 7 of the second blade 3 just above the skin surface 23, and said cutting edge severs the hair 25 completely. Meanwhile, the first blade 1 is displaced by the drive unit 11 from the second position, in an oblique direction with respect to the skin surface 23, to a third position shown in the FIGS. 1*c* and 1*d*, in which the first blade 1 is situated behind the second blade 3, viewed relatively to the skin surface 23. Subsequently, the first blade 1 is displaced by the drive unit 11 from the third position to the first position shown in FIG. 1*a*. After the hair 25, which is partly extracted from the skin, has been severed by the second blade 3, a remaining hair part 25' of the hair 25 is retracted into the skin by skin tissue present around the hair part 25'. As shown in FIG. 1*d*, this causes the remaining hair part 25' to sink back below the skin surface 23. As a result of this so-called retractile action of the shaver in accordance with the invention, not only a very smooth shaving result is obtained, but said shaving result additionally lasts for a longer period of time because the remaining hair part 25' does not grow beyond the skin surface 23 until after a considerable period of time.

The cutting edge 5 of the first blade 1 should penetrate the hairs over a distance such that the hairs can be pulled along by the first blade 1 over a small distance in the cutting direction X, without being severed or broken off by said first blade 1. It has been found that, in order to achieve this, the aforementioned distance d between the cutting edge 5 and the blocking element 15 must be substantially smaller than an average diameter of the hairs to be shaved by means of the shaver in accordance with the invention. It has been found that, with respect to shaving beard hairs, which generally have an average diameter of approximately 100 $\mu$m, good results are achieved if the distance d ranges between 10 $\mu$m and 50 $\mu$m. In the case of shaving beard hairs, it has been found that a substantially optimum retractile action is obtained if, analogous to the above-described example of the shaver in accordance with the invention, said distance d is approximately 30 $\mu$m. If the shaver in accordance with the invention is used to shave another hair type, such as hair of the legs, the shaver can be provided, for optimum retractile action, with a distance d between the cutting edge 5 of the first blade 1 and the blocking element 15, which is adapted to the other hair type.

By virtue of the fact that the blocking element 15 is provided on the side face 17 of the first blade 1 facing away from the second blade 3, it is achieved that the distance over which the cutting edge 5 of the first blade 1 penetrates the hairs is substantially equal to the distance d between the cutting edge 5 of the first blade 1 and the blocking element 15. As a result thereof, it is additionally achieved that, in the first position of the first blade 1 shown in FIG. 1*a*, the cutting edges 5 and 7 of both blades 1 and 3 are as closely spaced as possible, so that a hair which is partly extracted from the skin is directly severed by the second blade 3. As a result, a reliable and reproducible operation of the shaver in accordance with the invention is attained. It is noted, however, that the invention also includes shavers in which the blocking element is provided on the side face of the first blade 1 facing the second blade 3, or shavers in which both side faces of the first blade 1 are provided with a blocking element.

In the above-described example of the shaver in accordance with the invention, the blocking element 15 is formed by the front side 19 of the carrier 13 on which the blade part 14 of the first blade 1 is secured. By virtue thereof, a simple and practical construction of the shaver in accordance with the invention is obtained. It is noted that the invention also includes shavers wherein the first blade is provided with a different type of blocking element, such as a strip or wire extending parallel to the cutting edge of the first blade, or a number of strip or wire segments which are arranged next to one another, viewed parallel to the cutting edge of the first blade, or one or more stops which are formed so as to be integral with the first blade.

Figure 2:
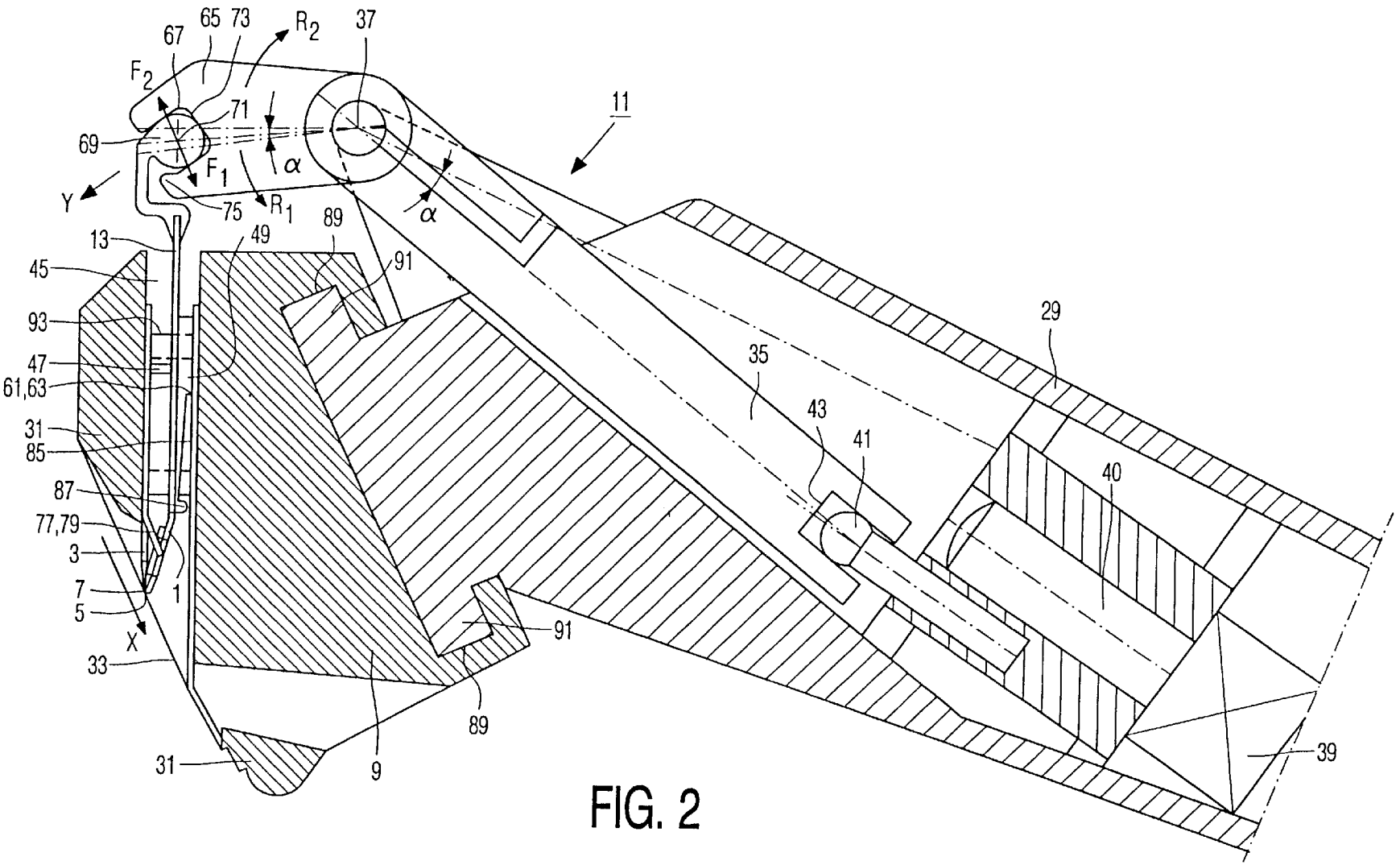
FIG. 2 shows a shaver in accordance with the invention.

As shown in FIG. 2, the first blade 1 and the second blade 3 are provided, in the shown example of the shaver in accordance with the invention, in the above-mentioned shaving head 9 which is detachably secured to a holder 29 which a user of the shaver can hold in his hand. The shaving head 9 further comprises a skin-support element 31 which, during operation of the shaver, bears against the skin to be treated. As shown in FIG. 2, the cutting edges 5 and 7 of the blades 1 and 3 substantially extend in a hair cutting plane 33, which extends substantially parallel to the cutting direction X of the blades 1 and 3 and touches the skin-support member 31. By virtue thereof, it is achieved that, during displacing the shaving head 9 over the skin, the blades 1 and 3 are moved along, clear of the skin surface, so that skin lesions caused by the blades 1 and 3 are precluded as much as possible.

FIG. 2 further shows that the above-mentioned drive unit 11 comprises a pivotal arm 35 which is mounted with respect to the holder 29 so as to be pivotable through a limited angle $\alpha$ about a first pivot axis 37, which extends parallel to the cutting edges 5 and 7. The drive unit 11 further includes an electric motor 39 having an output shaft 40 which is arranged in the holder 29 to drive an eccentric 41. The pivotal arm 35 includes a groove 43 for co-operation with the eccentric 41, which groove extends parallel to the first pivot arm 37. The use of the eccentric 41 and the groove 43 enables the pivotal arm 35 to be oscillated about the first pivot axis 37 by means of the electric motor 39.

Figure 3:
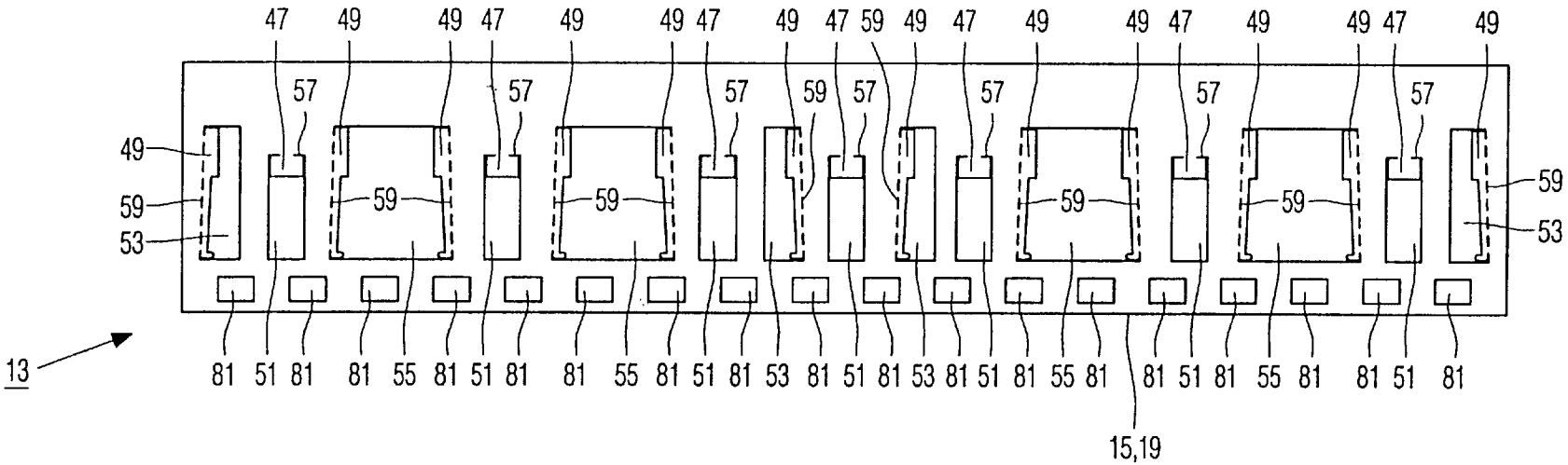
FIG. 3 shows a carrier of a drive unit of the shaver in accordance with FIG. 2.

As FIG. 2 further shows, the carrier 13 of the first blade 1 is arranged in a guide channel 45 which is formed in the shaving head 9 and extends obliquely with respect to the hair cutting plane 33. The carrier 13 is shown in a side view in FIG. 2 and in a front view in FIG. 3. As shown in FIGS. 2 and 3, the carrier 13 includes a first group of lugs 47 and a second group of lugs 49. As shown in FIG. 3, the lugs 47 and 49 are formed by incisions in the plate-shaped carrier 13, the lugs 47 of the first group bordering on openings 51 in the carrier 13, and the lugs 49 of the second group bordering on openings 53 and 55 in the carrier 13. The first group of lugs 47 and the second group of lugs 49 are bent from the plate-shaped carrier 13 in mutually opposite directions and extend substantially perpendicularly to the carrier 13. It is noted that FIG. 3 shows the lugs 47 and 49 in a position wherein the lugs 47, 49 have not yet been bent from the carrier 13 during the manufacture of said carrier 13. In FIG. 3, the bending lines of the lugs 47 of the first group are indicated by reference numeral 57, while the bending lines of the lugs 49 of the second group are represented by reference numeral 59. As shown in FIG. 2, the carrier 13 of the first blade 1 is displaceably guided in said guide channel 45 by means of the lugs 47 and 49. The lugs 49 of the second group also determine a second pivot axis 61 about which the carrier 13 can be pivoted through limited angles in the guide channel 45. The second pivot axis 61 extends approximately through the angular points 63 of the lugs 49 of the second group and is directed substantially parallel to the first pivot axis 37.

As FIG. 2 further shows, the drive unit 11 comprises a coupling member 65 which is secured in a fixed position to the pivotal arm 35. In the coupling member 65, there is provided a hinge channel 67 which extends parallel to the first pivot axis 37 and which serves to co-operate with two spherical or cylindrical hinge elements 69 which are secured to the carrier 13 of the first blade 1. It is noted that FIG. 2 only shows one of the two hinge elements 69. Since the coupling member 65 is secured in a fixed position to the pivotal arm 35, the coupling member 65 and the pivotal arm 35 can be jointly oscillated, by means of the electric motor 39, about the first pivot axis 37 through the limited angle $\alpha$. The hinge elements 69 can be hinged in the hinge channel 67 about a hinge axis 71 extending parallel to the first pivot axis 37. The hinge elements 69 can also be slid in the hinge channel 67 over a limited distance in a Y-direction transverse to the hair cutting plane 33 between a first stop 73, which is formed by a side wall of the hinge channel 67, and a second stop 75, which is formed by a raised side edge of the hinge channel 67.

As shown in the FIGS. 1*a* through 1*d* and in FIG. 2, the shaving head 9 of the shaver is further provided, near the hair cutting plane 33, with a guide 77 for the first blade 1, which guide extends substantially parallel to the cutting direction X. The guide 77 includes a number of strips 79, which extend substantially parallel to the cutting direction X, and which are formed by incisions in the second blade 3 and are bent from said second blade 3. As shown in detail in FIGS. 1*a* through 1*d*, the strips 79 extend through openings 81 and 83 which are provided, respectively, in the carrier 13 and the blade part 14 of the first blade 1. The openings 81 in the carrier 13 are also visible in FIG. 3.

By virtue of the above-described construction of the shaver, the above-mentioned substantially triangular or quadrangular path 21, in accordance with which the first blade 1 is displaced with respect to the second blade 3 by the drive unit 11, is obtained in the following manner. In operation, the coupling member 65 alternately rotates in a positive direction of rotation $R_1$, shown in FIG. 2, the first blade 1 being displaced in the cutting direction X, and in a negative direction of rotation $R_2$. During a rotation of the coupling element 65 in the positive direction of rotation $R_1$, the hinge elements 69 of the first blade 1 bear against the first stop 73 of the hinge channel 67, and the coupling member 65 exerts a drive force $F_1$ on the hinge elements 69 shown in FIG. 2, which drive force has a positive mechanical torque about the second pivot axis 61. Under the influence of the positive torque, the carrier 13 bears with the lugs 49 against a side wall 85 of the guide channel 45, and the blade part 14 bears against the guide 77, as shown in detail in FIGS. 1*a* and 1*b*. As a result, the cutting edge 5 of the first blade 1 is accurately displaced along the guide 77 in a direction substantially parallel to the cutting direction X, from the first position shown in FIG. 1*a* to the second position shown in FIG. 1*b*. Since the cutting edge 5 of the first blade 1 is guided along the guide 77 in the manner described above, skin lesions caused by the first blade 1 are precluded as much as possible. During a subsequent rotation of the coupling member 65 in the negative direction of rotation $R_2$, the coupling member 65 exerts a drive force $F_2$ on the hinge elements 69 shown in FIG. 2, which drive force $F_2$ has a negative mechanical torque about the second pivot axis 61. Under the influence of the negative torque, the hinge elements 69 of the first blade 1 bear against the second stop 75 of the hinge channel 67, so that the carrier 13 is rotated in the guide channel 45, through a limited angle, about the second pivot axis 61. As a result, the carrier 13 bears with the angular points 63 of the lugs 49 and with the supports 87 of the lugs 49 against the side wall 85 of the guide channel 45, so that the cutting edge 5 of the first blade 1 is displaced, in a direction oblique to the cutting direction X, from the second position shown in FIG. 1*b* to the third position shown in FIG. 1*c*. If the direction of rotation of the coupling member 65 is subsequently reversed again, the carrier 13 is rotated about the second pivot axis 61 again and the first blade 1 returns to the first position shown in FIG. 1*a*.

The shaving head 9 of the shaver in accordance with the invention, shown in FIG. 2, is detachably secured to the holder 29, and the drive unit 11 is detachably coupled to the first blade 1, so that the shaving head 9 with the blades 1 and 3 can be replaced if, after a number of shaves, the blades 1 and 3 have become blunt. For this purpose, the shaving head 9 is provided with a coupling guide 89 which extends parallel to the first pivot axis 37 and which serves to co-operate with a further coupling guide 91 of the holder 29 which also extends parallel to the first pivot axis 37, and the two co-operating coupling guides 89 and 91 can be separated by moving them apart in a direction parallel to the first pivot axis 37. During separating the coupling guides 89 and 91, the carrier 13 of the first blade 1 is simultaneously decoupled from the drive unit 11 in that both hinge elements 69 of the first blade 1 are also slid from the hinge channel 67 of the coupling member 65, which hinge channel is also directed parallel to the first pivot shaft 37. In this manner, a particularly simple and practical coupling between the shaving head 9 and the holder 29, and between the first blade 1 and the drive unit 11 is obtained. In the decoupled state of the shaving head 9, the first blade 1 is held in position with respect to the shaving head 9 by means of a number of ring-shaped support elements 93, which are situated in the guide channel 45 and extend through the openings 55 in the carrier 13. In FIG. 2, one of the support elements 93 is shown in side view. It is noted that there is a clearance between the openings 55 and the support elements 93, so that the first blade 1 can be displaced relatively to the shaving head 9 and the supporting elements 93 in the manner described hereinabove.

In the above-described example of the shaver in accordance with the invention, the first blade 1 is periodically displaced with respect to the second blade 3 in accordance with an approximately triangular or quadrangular path 21. It is noted that the first blade 1 may alternatively be periodically displaced relatively to the second blade 3 in accordance with a different path. According to the invention, such a different path should at least comprise a path part which extends, parallel to the cutting direction, from the first position shown in FIG. 1*a* to the second position shown in FIG. 1*b*.

It is further noted that, instead of the above-described drive unit 11, the shaver in accordance with the invention may alternatively comprise a different type of drive unit for driving the first blade, such as a drive unit comprising one or more piezo actuators.

It is finally noted that the shaver in accordance with the invention may alternatively comprise a shaving head which cannot be detached from the holder or a shaving head which is detachably secured to the holder in a different manner.

What is claimed is:

1. A shaver comprising a skin-support element, a first blade, and a second blade which, viewed in a cutting direction of the blades, follows t he first blade, said blades being provided with substantially parallel cutting edges extending perpendicularly to the cutting direction and substantially in a hair cutting plane touching the skin-support element, wherein a blocking agent is provided on a side face of then first blade, at a distance from the cutting edge of the first blade which, viewed in the cutting direction, is substantially smaller than hairs to be shaved by means of the shaver, thereby pulling hairs away from the skin and said cutting edge partially penetrating said hairs, the blocking agent being incapable of penetrating said hairs, and the shaver comprises a drive unit mechanically coupled to the first blade for moving said first blade in respect to the second blade, which is stationary, substantially in the cutting direction from a first position in which the cutting edge of the first blade is situated close to the cutting edge of the second blade, to a second position.

2. A shaver as claimed in claim 1, wherein the distance between the cutting edge of the first blade and the blocking element ranges between 10 $\mu$m and 50 $\mu$m.

3. A shaver as claimed in claim 2, wherein the distance between the cutting edge of the first blade and the blocking element is substantially 30 $\mu$m.

4. A shaver as claimed in claim 1, wherein the blocking element is provided on a side face of the first blade facing away from the second blade.

5. A shaver as claimed in claim 1, wherein the first blade comprises a carrier on which a blade part including the cutting edge of the first blade is secured, the blocking element being a front side of the carrier extending transversely to the side face of the first blade.

6. A shaver as claimed in claim 1, wherein the shaver is provided, near the hair cutting plane, with a guide extending substantially parallel to the cutting direction, along which guide the first blade is guided during displacements from the first position to the second position.

7. A shaver as claimed in claim 6, wherein the guide comprises at least one strip which extends substantially parallel to the cutting direction, which strip is formed by incisions in the second blade and is bent from said second blade.

8. A shaver as claimed in claim 6, wherein the drive unit is provided with a coupliong member adapted to being oscillated, through a limited angle, about a first pivot axis while the first blade is displaceable guided in a guide channel of the shaver, which channel extends obliquely with respect to the hair cutting plane, the first blade being pivotable through limited angles, in the guide channel about a second pivot axis extending parallel to the first pivot axis, the first blade being provided with at least one hinge element adapted to be hinged in a hinge channel of the coupling member extending parallel to the first pivot axis an which hinge element is adapted to being displaced in the hinge channel in a direction transverse to the hair cutting plane.

9. A shaver as claimed in claim 8, wherein the second pivot axis is determined by lugs, which are formed by incisions in the first blade and are bent from the first blade, the first blade also being displaceably guided in the guide channel by means of said lugs.

10. A shaver as claimed in claim 1, wherein the skin-support element and the two blades form part of a shaving head of the shaver, which shaving head is detachably secured to a holder of the shaver, the drive unit being situated in the holder and being detachably coupled to the first blade.

11. A shaving head as claimed in claim 8, wherein the skin-support element and the two blades form part of a shaving head of the shaver, which shaving head is detachably secured to a holder of the shaver, the drive unit being situated in the holder and being detachably coupled to the first blade.

12. A shaver as claimed in claim 11, wherein the shaving head is provided with a coupling guide extending parallel to the two pivot axes, which coupling guide serves to co-operate with a further coupling guide of the holder, the shaving head being detachable from the holder by sliding both coupling guides apart in a direction parallel to both pivot axes, the first blade simultaneously being detachable from the drive unit by sliding the hinge element of the first blade out of the hinge channel of the coupling member in a direction parallel to the two pivot axes.

* * * * *